US006673234B2

(12) United States Patent
Li et al.

(10) Patent No.: US 6,673,234 B2
(45) Date of Patent: Jan. 6, 2004

(54) COMBINED PROCESS OF LOW DEGREE SOLVENT DEASPHALTING AND DELAYED COKING

(75) Inventors: Rui Li, Beijing (CN); Zijun Wang, Beijing (CN); Jun Long, Beijing (CN)

(73) Assignees: China Petroleum and Chemical Corporation, Beijing (CN); Research Institute of Petroleum Processing, Sinopec, Beijing (CN)

( * ) Notice: Subject to any disclaimer, the term of this patent is extended or adjusted under 35 U.S.C. 154(b) by 71 days.

(21) Appl. No.: 09/965,601

(22) Filed: Sep. 25, 2001

(65) Prior Publication Data

US 2002/0112986 A1 Aug. 22, 2002

(30) Foreign Application Priority Data

Sep. 25, 2000 (CN) ..... 00124904 A

(51) Int. Cl.[7] ..... C10C 3/00

(52) U.S. Cl. ..... 208/86; 208/87; 208/45; 208/39; 208/131; 208/309

(58) Field of Search ..... 208/86, 87, 45, 208/39, 131, 309

(56) References Cited

U.S. PATENT DOCUMENTS 4,686,027 A * 8/1987 Bonilla et al. ..... 208/39
4,859,284 A * 8/1989 Rammler et al. ..... 201/12
6,048,448 A * 4/2000 Nirell ..... 208/67

FOREIGN PATENT DOCUMENTS

EP 0 673 989 A2 * 9/1995 ..... 55/4

* cited by examiner

*Primary Examiner*—Walter D. Griffin
*Assistant Examiner*—James Arnold, Jr.
(74) *Attorney, Agent, or Firm*—Pennie & Edmonds LLP

(57) ABSTRACT

A combined process of low degree solvent deasphalting and delayed coking, which comprises feeding a deasphalting stock and a solvent into an extractor and making the yield of the deasphalted oil 70 wt %–95 wt %, and introducing a part or all of the deasphalted oil and optionally a conventional coking stock into a delayed coker. This process increases the yield of liquid products, removes the heavy asphaltene which is prone to coke, extends the run length of the delayed coker, and at the same time, lowers the content of impurities in coke, enlarges the sources of the stocks for producing the needle coke.

16 Claims, 4 Drawing Sheets

COMBINED PROCESS OF LOW DEGREE SOLVENT DEASPHALTING AND DELAYED COKING

FIELD OF THE ART

The present invention is related to a multi-step process for treating hydrocarbon oil by means of a refining process and a cracking process in the absence of hydrogen. More particularly, it is a combined process of low degree solvent deasphalting and delayed coking.

BACKGROUND OF THE INVENTION

Solvent deasphalting is an important technology for upgrading residue. It is a physical liquid-liquid extraction process, the basic principle of which is to carry out separation according to the difference in the solubility of various components in residue in hydrocarbon solvents. Solvent mainly dissolves saturates and aromatics and removes most resin and asphaltene in residue by regulating the operation conditions and controlling the dissolving ability of the solvent, and thereby yields deasphalted oil which has high hydrogen/carbon ratio, low carbon residue, low impurity content and can meet the requirement of feed for the downstream process. A typical solvent deasphalting process comprises introducing the stock (usually vacuum residue) into the upper part of the extractor after heat exchange to attain an adequate temperature and introducing the solvent at a certain temperature from the lower part of the extractor. The two streams flow counter-currently and come into contact in the extractor. Resin and asphaltene settle in the bottom of the extractor and the deasphalted oil enters into the settling section via the pipe riser, and then the solvent in the deasphalted oil and the asphalt is recovered respectively. The solvent is recycled for reuse.

Delayed coking is a thermal processing technology which converts the residue into gas, gasoline, diesel, gas oil, and coke by deep thermal cracking. The process of the conventional delayed coking is: after preheating in the convection section of the furnace, the stock enters into the coking fractionator, and then enters into the radiation section of the furnace, wherein it is heated to 500° C. The heated stock enters the coker drum to carry out the coking reaction and producing coking distillate, oil and vapor escape from the top of the coker drum and enter into the fractionator to be separated into dry gas, gasoline, diesel, gas oil, while coke aggregates in the coker drum. The recycle ratio in the conventional delayed coking technology generally is 0.4.

The combination of solvent deasphalting with other heavy oil processing technologies has been a subject of research. For example, EP 209225A2 discloses a process for processing residues by combining a solvent deasphalting unit and a delayed coker. This process raises the linear velocity of the unrecovered solvent in the deoiled asphalt by vaporization in the furnace tube and makes full use of the heat source of the delayed coker to recover the solvent in the solvent deasphalting unit to achieve the goal of saving energy, but does not describe the reuse of the solvent.

V. K. Patel, et al set forth in "Economic Benefits of ROSE/Fluid Coking Integration, 1997 NPRA, AM-97-50" combining the solvent deasphalting ROSE technology with fluidized coking to process heavy residues at a deep degree. Meanwhile, they also suggest a scheme combined solvent deasphalting and delayed coking, i.e., coking the deoiled asphalt, but this technology has the problems that the deoiled asphalt becomes heavier and that the furnace tube is prone to coke, and so on.

U.S. Pat. No. 4,859,284 combines solvent deasphalting and coking for treating high softening point asphalt and applies a double-screw mixing reactor to the coking section. This process will encounter engineering problems in large-scale industrial production, EP 673989A2 combines solvent deasphalting and pyrolysis and more than 50% of the obtained deasphalted oil selves as the feed of the pyrolysis unit to yield light oil products. Since the pyrolysis is restricted by coking, the conversion degree is affected.

The present invention uses a process which combines low degree solvent deasphalting and delayed coking, i.e. uses low degree deasphalted oil rather than deoiled asphalt as a part of the feed for delayed coking and thereby makes the yield of the deasphalted oil 70 wt %–95 wt % relative to the deasphalting stock. Only heavy asphalt is removed from the stock, and the soft asphalt still remains ill the feed for the delayed coker; therefore on the one hand, the coking of the furnace tube of the delayed coking is avoided and the operation period of the delayed coker is extended, on the other hand, the yield of the liquid products of delayed coking is raised. Meanwhile, the content of the impurities in coke is reduced, and the quality of the coke product is improved.

The object of the present invention is therefore to provide a combined process of low degree deasphalting and delayed coking based on the prior art.

In the steel production wherein high power electrode is used, it is necessary to use a high or ultra-high power graphite electrode being able to bear rapid changes in conditions in a short time. For the purpose of the electrodes not cracking due to a relatively large thermal stress in rapid heating or cooling, the coefficient of thermal expansion (CTE) becomes a key index of the petroleum coke product used for high power electrode. The petroleum coke used for high power electrode exhibits a needle shape in appearance after it is cracked, and has an obvious fiber structure in micrograph and has a strong anisotropy. It has a series of merits such as low CTE, and good graphitization ability. Therefore it is a skeleton material for fabricating high power electrodes and is widely applied in the fields of steel production, aerospace, etc.

The indices of the quality of the petroleum coke used for high power electrode are shown below:

Real density, $g/cm^3 > 2.12$

CTE (RIPP method), $\times 10^{-6}$/° C. 2.35–2.60

Sulfur content, wt % not more than 0.7

Ash, wt % not more than 0.15

The theoretical basis for the production technique of petroleum coke used for high power electrode is the formation mechanism of the mesophase and lie commonly used stock is catalytically cracking decanted oil, thermal cracking residue, extract from lube solvent refining and ethylene tar, etc. Although it is possible to produce petroleum coke used for high power electrode from the aforesaid stocks through different pretreating technologies, it is difficult to realize larger scale of production due to limited resources.

U.S. Pat. No. 4,178,229 discloses a process for producing premium petroleum coke from straight-run vacuum residue, wherein the vacuum residue first converts to distillate oil and asphalt, and the asphalt is cracked together with a hydrogen donor to produce the stock for producing premium petroleum coke. Since this patent uses a hydrocracking process to treat the residues the operation cost and expense are increased.

U.S. Pat. No. 4,130,475 discloses a process for producing premium petroleum coke from atmospheric residue, wherein the major stock is atmospheric residue and a small potion of residue for ethylene is incorporated therein. The mixture directly enter into a delayed coker without any other treatments, and the distillate oil produced in the coker subjects to thermal cracking reaction via two thermal cracking furnaces. The thermal cracking residue formed in the reaction returns to the feed inlet of the coker and mixes with the atmospheric residue. This patented technique exerts a special limit to the atmospheric residue stock since the atmospheric residue stock is not subjected to any chemical treatment, but only other stocks are added thereto and mixed. Therefore, the sources of the stock are restricted.

The present invention make the yield of the deasphalted oil 70 wt %–95 wt % by using a combined process of low degree deasphalting and delayed coking, wherein the low degree deasphalted oil rather than the deoiled asphalt serves as a part of the feed for the delayed coking. The low degree deasphalted oil is produced by only removing the asphaltene in the stock, and most of the oils and resins in the stock still remains, therefore on the one hand, coking of the furnace tube of the delayed coker is avoided and the run length of the delayed coker is extended, on the other hand, the yield of the liquid products of delayed coking is raised. Meanwhile, the sources of the stocks for producing the needle coke are enlarged and the content of the impurities in the needle coke is lowered.

Therefore, another object of the present invention is to provide a combined process of low degree solvent deasphalting and delayed coking based on the prior art to produce needle petroleum coke used for high power electrode while increase the yield of the liquid products.

BRIEF DESCRIPTION OF THE INVENTION

The present invention provides a combined process of low degree solvent deasphalting and delayed coking, which comprises the following steps:

(1) A preheated deasphalting stock and a solvent enter into an extractor, and a solvent-containing deoiled asphalt solution is withdrawn from the bottom of the extractor. The deasphalted oil solution from the top of the extractor yields deasphalted oil after recovering the solvent. The yield of the deasphalted oil is 70 wt %–95 wt % relative to the deasphalting stock; and (2) A part or all of the deasphalted oil and the coker recycle oil, and optionally another conventional coking stock enter into the convection section of the furnace of the delayed coker for heating, then enter into the radiant section of the furnace for heating, and finally enter into a coker drum to conduct the coking reaction. Coke remains in the coker drum, coker oil and vapor escape from the coker drum and then enter into the fractionator, wherein they are separated into gas, gasoline, diesel, and gas oil.

The present invention also provides a combined process of low degree solvent deasphalting and delayed coking, which comprises the following steps:

(1) A preheated deasphalting stock and a solvent enter into an extractor, and a solvent-containing deoiled asphalt solution is withdrawn from the bottom of the extractor. The deasphalted oil solution from the top of the extractor yields the deasphalted oil after recovering the solvent. The yield of the deasphalted oil is 70 wt %–95 wt % relative to the deasphalting stock;

(2) A part or all of the deasphalted oil and coker recycle oil enter into the furnace of a mild thermal converter, and the light components obtained by separating the heated stream enter into the fractionator of the delayed coker while the heavy components enter into the furnace of the delayed coker; and (3) The heavy components subjected to the mild thermal reaction and optionally another needle coke stock enter into the furnace of the delayed coker for heating and then enter into the coker drum for coking reaction. Coker oil and vapor escape from the top of the coker drum and enter into the fractionator to be separated into gas, gasoline, diesel, and gas oil. The coker recycle oil is mixed with deasphalted oil and the mixture enters into the furnace of the mild thermal converter, and the needle coke remains in the coker drum.

DETAILED DESCRIPTION OF THE INVENTION

Figure 1:
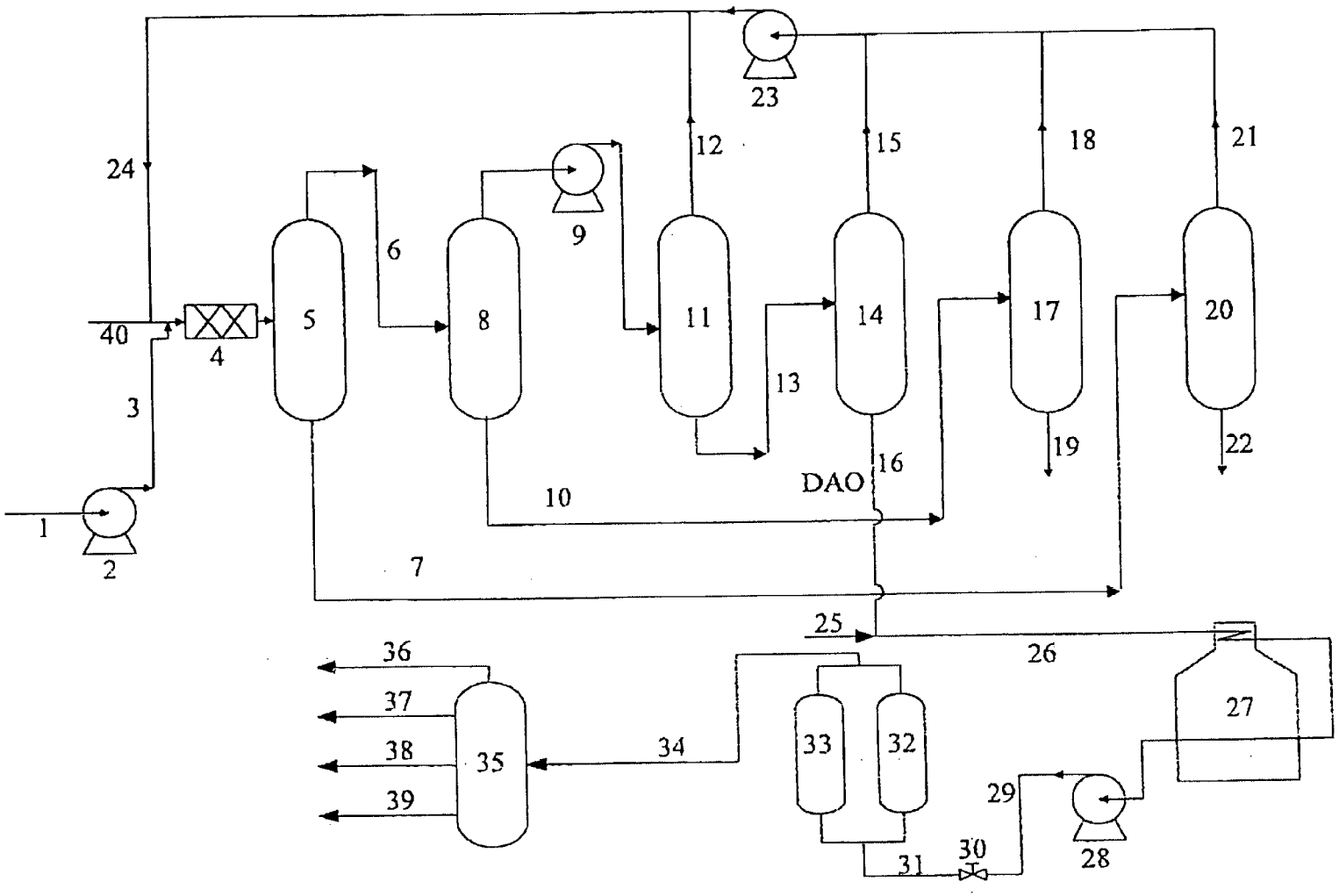
FIG. 1 schematically represents the combined process of the two-stage solvent deasphalting and delayed coking for producing ordinary coke.

The present invention provides a combined process of low degree solvent deasphalting and delayed coking, which comprises two embodiments. One is used to produce ordinary coke, the other is used to produce needle coke.

The first embodiment of the present invention comprises the following steps:

(1) The preheated deasphalting stock and the solvent enter into the extractor and conduct extraction under the conditions of a temperature of 60° C.–280° C., a pressure of 1.0 MPa–6.0 MPa, and a solvent/oil ratio of 1.0 v/v–15.0 v/v. The solvent-containing deoiled asphalt solution is withdrawn from the bottom of the extractor and the deasphalted oil (DAO) solution from the top of the extractor yields DAO after recovering the solvent; and (2) A part or all of the DAO, the coker recycle oil, and optionally another conventional coking stock enter into the furnace of the delayed coker for heating. The temperature at the outlet of the furnace is 480° C.–510° C., the recycle ratio is 0–0.25, and the pressure is 0.1 MPa–1.0 MPa. The heated stream enters into the coker drum for coking reaction. The coker oil and vapor escape from the top of the coker drum and enters into the fractionator to separate into gas, gasoline, diesel, and gas oil. The coker recycle oil mixes with the DAO and the mixture enters into the furnace of the delayed coker, and the ordinary coke remains in the coker drum.

In the first embodiment, said conventional coking stock is one selected from the group consisting of vacuum residue, atmospheric residue, visbreaking cracked residue, catalytically cracking decanted oil, thermal cracking residue, heavy oil hydrogenated tail oil, extract from lube solvent refining or ethylene tar, or a mixture thereof.

The second embodiment of the present invention comprises the following steps:

(1) A preheated deasphalting stock and a solvent enter into the extractor, and conduct extraction under the conditions of a temperature of 60° C.–280° C., a pressure of 1.0 MPa–6.0 MPa, and a solvent/oil ratio of 1.0 v/v–15.0 v/v. The solvent-containing deoiled asphalt solution is withdrawn from the bottom of the extractor and the DAO solution from the top of the extractor yields DAO after recovering the solvent;

(2) A part or all of the DAO and the coker recycle oil enter into the furnace of a mild thermal converter. The temperature at the outlet of the furnace of the mild thermal converter is 370° C.–510° C., the amount of the injected water accounts for 0 wt %–20 wt % of the feed, the pressure is 0 MPa–1.0 MPa, and the residence time is 2 s–180 s. The light components obtained by separating the heated stream enter into the fractionator of the delayed coker and the heavy components enter into the furnace of the delayed coker; and (3) The heavy components subjected to the mild thermal reaction and optionally another stock of needle coke enter into the furnace of the delayed coker for heating. The temperature at the outlet of the furnace of the delayed coker is 430° C.–520° C., the recycle ratio is 0–0.25, the pressure is 0.1 MPa–1.0 MPa, the amount of the injected water accounts for 0–20 wt % of the feed, and the residence time is 2 s–180 s. The heated stream enters into the coker drum for coking reaction. The coker oil and vapor escape from the top of the coker drum and enter into the fractionator to separate into gas, gasoline, diesel, and gas oil. The coker recycle oil mixes with the DAO and the mixture enters into the furnace of the mild thermal converter, and the needle coke remains in the coker drum.

In the second embodiment, said another needle coke stock is one selected from the group consisting of catalytically cracking decanted oil, thermal cracking residue, heavy oil hydrogenated tail oil, extract from lube solvent refining or ethylene tar, or a mixture thereof.

In step (2) of the second embodiment, the gas, gasoline and diesel produced in the mild thermal conversion process are removed, since these light components are unfavorable to the growth of the mesophase. Only heavy component is suitable for producing the needle coke.

In the above two embodiments, said deasphalting stock is one selected from the group consisting of vacuum residue, atmospheric residue, visbreaking cracked residue, catalytically cracking decanted oil, thermal cracking residue, heavy oil hydrogenated tail oil, extract from lube solvent refining or ethylene tar, or a mixture thereof.

The solvent used in deasphalting is one selected from the group consisting of $C_3$–$C_7$ alkanes or olefins, condensed oil, light naphtha, and light gasoline, or a mixture thereof, and preferably is $C_4$–$C_6$ alkanes or olefins, or a mixture thereof.

The deasphalting stock and the solvent may enter into the extractor from the upper part and lower part respectively and come into countercurrent contact, or may be pre-mixed before entering into the extractor for separation.

Solvent deasphalting may be conducted under either the subcritical conditions of the solvent, or the supercritical conditions of the solvent. The subcritical conditions mean that the operation temperature and pressure are lower than the critical temperature and critical pressure of the solvent respectively. The supercritical conditions mean that the operation temperature and pressure are higher than the critical temperature and critical pressure of the solvent respectively.

Solvent deasphalting may use an one-stage process, i.e. the liquid stream from the top of the extractor is subjected to solvent recovery to yield DAO, a part or all of which may be further subjected to deep thermal cracking alone as a feed for delayed coking, or mixed with a conventional coking stock as a feed for delayed coking. The solvent in the DAO solution may be recovered by sequential critical recovery, flashing and stripping or by sequential supercritical recovery, flashing and stripping. The critical recovery means that the separation of DAO from the solvent is completed at the state close to the critical one of the solvent, and the supercritical recovery means that the separation of DAO from the solvent is completed at the supercritical state of the solvent. Compared with the individual flashing (also referred to as evaporation), the critical recovery process or supercritical recovery process can save energy. The solvent in the asphalt solution may be recovered by sequential flashing and stripping processes.

Solvent deasphalting may also adopt a two-stage process, i.e. the liquid stream coming out from the top of the extractor is separated into a DAO solution and a resin solution via a settler. The DAO solution and the resin solution are respectively recovered with solvent to yield DAO and resin. The resin is also referred to as heavy deasphalted oil, which may serve either as a fuel oil, or as a doping component of the paving asphalt. A part or all of the DAO may be further subjected to deep thermal cracking alone as a feed for delayed coking, or may be mixed with a conventional coking stock as a feed for delayed coking. The process for recovering the solvent in the DAO solution is the same as the one-stage process, and the solvent in the resin solution and asphalt solution may be recovered by sequential flashing and stripping processes.

Low degree deasphalting may provide a maximum amount of high quality feed for coking, and the yield of the deasphalted oil is higher than 70 wt % but lower than 100 wt %, preferably 80–90% relative to the deasphalting stock.

The deoiled hard asphalt obtained in the low degree deasphalting may serve as a stock for gasification and circulating fluidized bed (CFB), a fuel for boilers of power plants, a stock for asphalt water slurry, a binder, etc.

The process provided by the present invention will be further explained below in combination with the drawings, wherein much equipment, such as the furnace, etc. is omitted, and the shape and size of the equipment and lines are not limited by the drawings, but defined by the particular situation.

FIG. 1 schematically represents the combined process of two-stage solvent deasphalting and delayed coking for producing ordinary coke. The process is as follows:

The stock enters into extractor 5 via line 1 after mixing in static mixer 4 with the fresh solvent and recycle solvent respectively from lines 40 and 24. The light phase solution obtained from the top of the extractor enters into settler 8 via line 6. The DAO solution obtained from the top of the settler enters into critical tower 11 after pressurization via pump 9. The solvent separated from the top of critical tower 11 returns to extractor 5 sequentially via line 12, line 24, and static mixer 4. The DAO containing a small amount of solvent obtained from the bottom of critical tower 11 enters into flash stripper 14 via line 13. The DAO obtained from the bottom of flash stripper 14 partly or entirely enters into the delayed coker via line 16. The solvent obtained from the top of flash stripper 14 returns to extractor 5 sequentially via line 15, pump 23, line 24, and static mixer 4. The resin solution obtained from the bottom of settler 8 enters into flash stripper 17 via line 10. The resin obtained from the bottom of flash stripper 17 leaves the unit via line 19. The solvent obtained from the top of flash stripper 17 returns to extractor 5 sequentially via line 18, pump 23, line 24, and static mixer 4. The heavy solution obtained from the bottom of extractor 5 enters into flash stripper 20 via line 7. The deoiled asphalt obtained from the bottom of flash stripper 20 leaves the unit via line 22. The solvent obtained from the top of flash stripper 20 returns to extractor 5 sequentially via line 21, pump 23, line 24, and static mixer 4.

The DAO from line 16 partly or entirely, alone or after mixed with a conventional coking stock from line 25, enters into coker drum 32 or 33 sequentially via line 26, the convection section and radiation section of furnace 27, wherein DAO is heated, pump 28, line 29, valve 30, and line 31. The produced coke remains in the tower, and the coker oil and vapor enter into the fractionator 35 via line 34. The obtained gas, gasoline, diesel, and gas oil leave the unit via lines 36, 37, 38, and 39 respectively.

Figure 2:
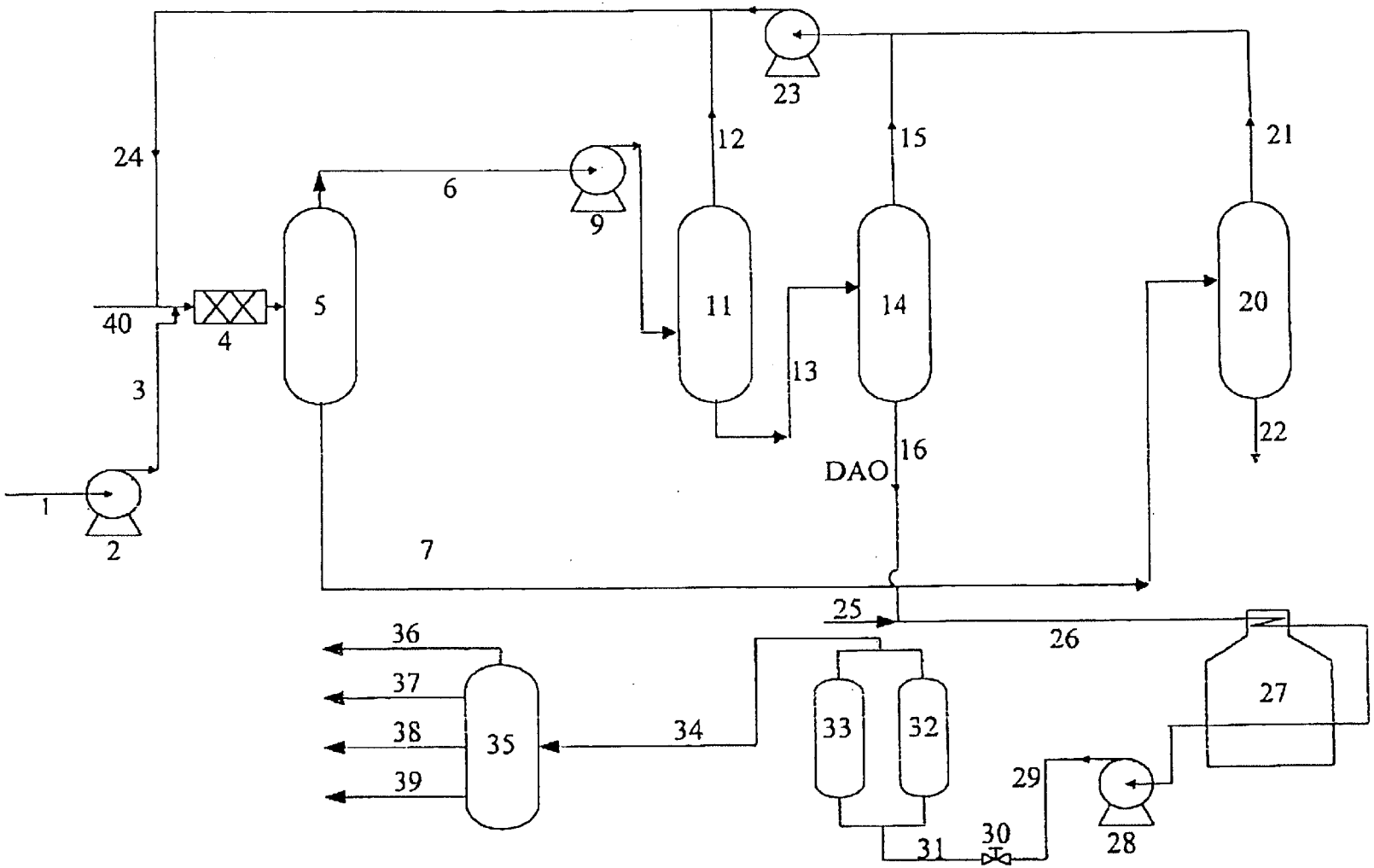
FIG. 2 schematically represents the combined process of the one-stage solvent deasphalting and delayed coking for producing ordinary coke.

FIG. 2 schematically represents the combined process of one-stage solvent deasphalting and delayed coking for producing ordinary coke. The process is as follows:

The stock from line 1 enters into extractor 5 after mixing in static mixer 4 with the fresh solvent and recycle solvent respectively from lines 40 and 24. The DAO solution obtained from the top enters into pump 9 via line 6 and enters into critical tower 11 after pressurization. The solvent separated from the top of critical tower 11 returns to extractor 5 sequentially via lines 12 and 24, and static mixer 4. The solvent obtained from the bottom of critical tower 11 enters into flash stripper 14 via line 13. The DAO obtained from the bottom of flash stripper 14 partly or entirely enters into the delayed coker via line 16, and the solvent obtained from the top of flash stripper 14 returns to extractor 5 sequentially via line 15, pump 23, line 24, and static mixer 4. The asphalt solution obtained from the bottom of extractor 5 enters into flash stripper 20 via lone 7. The deoiled asphalt obtained from the bottom of flash stripper 20 leaves the unit via line 22, and the solvent obtained from the top of flash stripper 20 returns to extractor 5 sequentially via line 21, pump 23, line 24, and static mixer 4.

The DAO from line 16 partly or entirely, alone or after mixed with a conventional coking stock from line 25, enters into coker drum 32 or 33 sequentially via line 26, the convection section and radiation section of furnace 27, wherein it is heated, pump 28, line 29, valve 30, and line 31. The produced coke remains in the tower, and the coker oil and vapor enter into fractionator 35. The obtained gas, gasoline, diesel, and gas oil leave the unit via lines 36, 37, 38, and 39 respectively.

Figure 3:
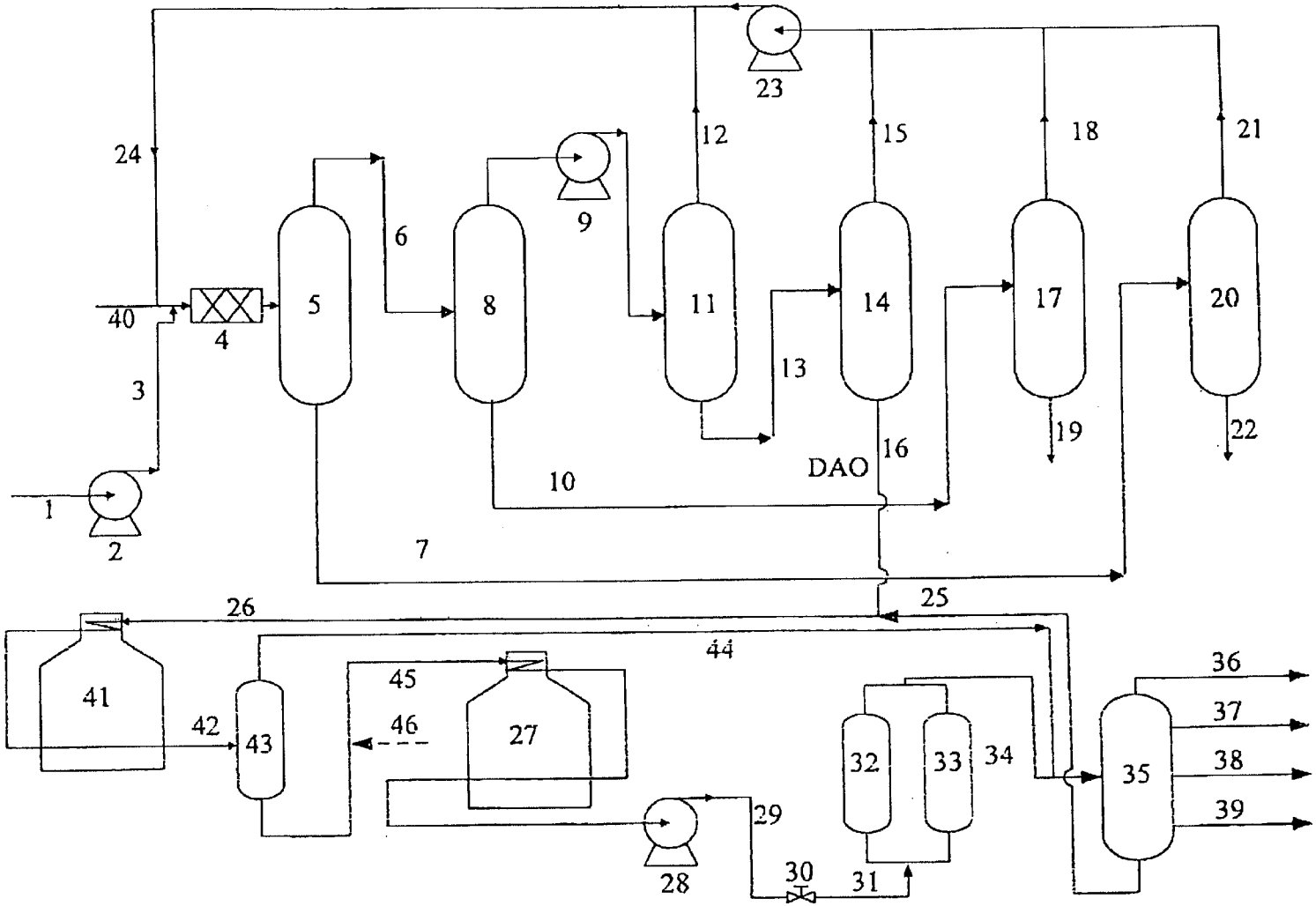
FIG. 3 schematically represents the combined process of the two-stage solvent deasphalting and delayed coking for producing needle coke.

FIG. 3 schematically represents the combined process of two-stage solvent deasphalting and delayed coking for producing the needle coke. The process is as follows:

The stock enters into extractor 5 sequentially via line 1, pump 2, and line 3 after mixing in static mixer 4 with the fresh solvent and recycle solvent respectively from lines 40 and 24. The light phase solution obtained from the top of the extractor enters into settler 8 via line 6. The DAO solution obtained from the top of the settler enters into critical tower 11 after pressurization via pump 9. The solvent separated from the top of critical tower 11 returns to extractor 5 sequentially via line 12, line 24, and static mixer 4. The DAO containing a small amount of solvent obtained from the bottom of critical tower 11 enters into flash stripper 14 via line 13. The DAO obtained from the bottom of flash stripper 14 partly or entirely enters into the delayed coker via line 16. The solvent obtained from the top of flash stripper 14 returns to extractor 5 sequentially via line 15, pump 23, line 24, and static mixer 4. The resin solution obtained from the bottom of settler 8 enters into flash stripper 17 via line 10. The resin obtained from the bottom of flash stripper 17 leaves the unit via line 19. The solvent obtained from the top of flash stripper 17 returns to extractor 5 sequentially via line 18, pump 23, line 24, and static mixer 4. The heavy phase solution obtained from the bottom of extractor 5 enters into flash stripper 20 via line 7. The deoiled asphalt obtained from the bottom of flash stripper 20 leaves the unit via line 22. The solvent obtained from the top of flash stripper 20 returns to extractor 5 sequentially via line 21, pump 23, line 24, and static mixer 4.

A part or all of the DAO from line 16 enters into the mild thermal converter furnace 41 via line 26 after mixed with the coker recycle oil from line 25 and enters into buffer tank 43 via line 42 after being heated. The light components separated from the top of buffer tank 43 enter into coking fractionator 35 via pipe 44 to separate into gas, gasoline, and diesel, and the separated heavy components serve as the stock for the needle coke. The heavy components separated from buffer tank 43 enter into the convection and radiation sections of coking furnace 27 together with another stock for the needle coke from line 46 for heating. Then the mixed stream enters into coker drum 32 or 33 sequentially via pump 28, line 29, valve 30, and line 31. The produced needle coke remains in the coker drum, and the coker oil and vapor enter into the fractionator 35 via line 34. The coker oil and vapor together with the light components obtained by mild thermal conversion are fractionated to yield gas, gasoline, diesel, and gas oil, which leave the unit respectively via lines 36, 37, 38, and 39. The coker recycle oil mixes with the DAO via line 25 and the mixture serves as the feed to mild thermal converter furnace 41.

Figure 4:
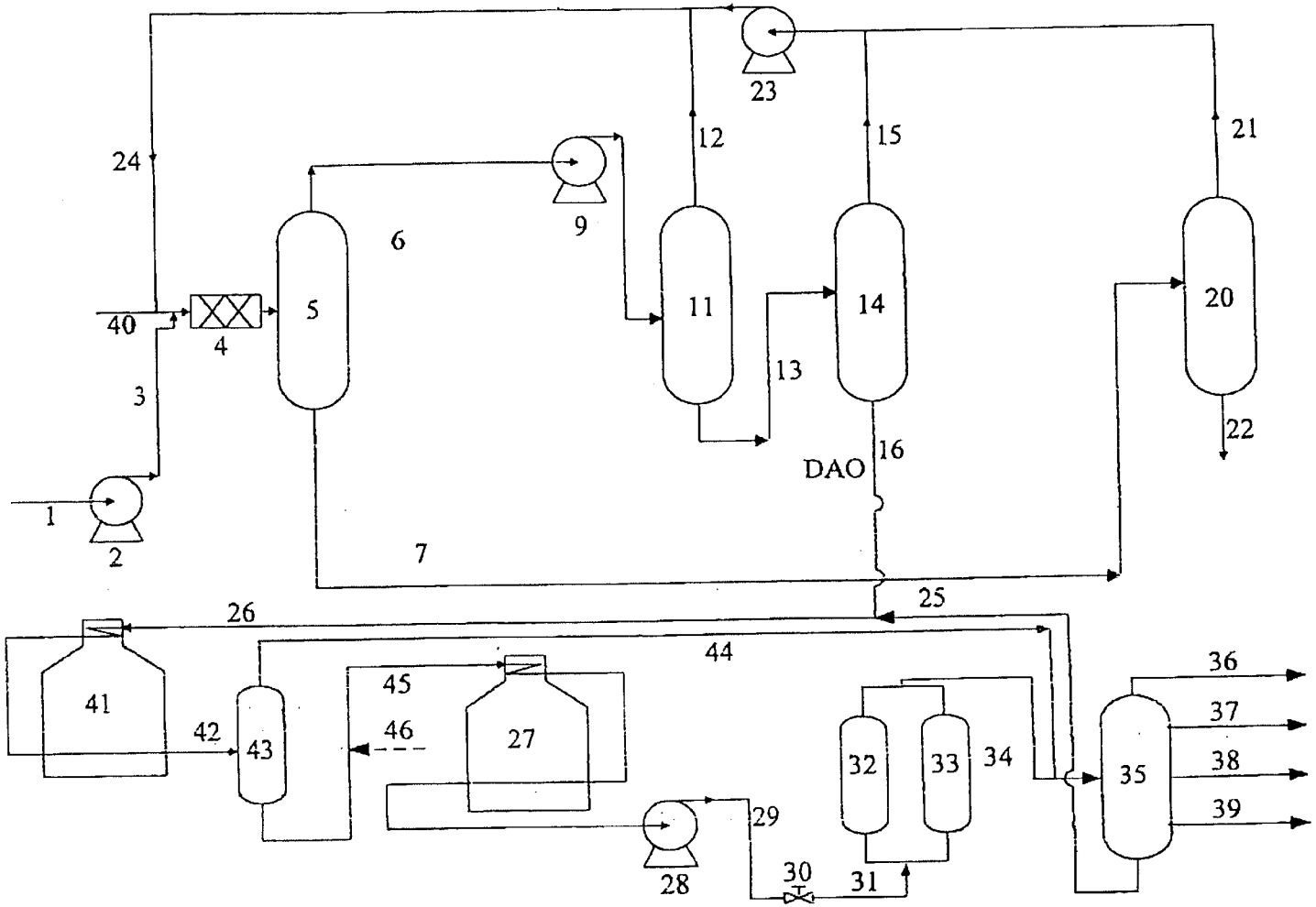
FIG. 4 schematically represents the combined process of the one-stage solvent deasphalting and delayed coking for producing needle coke.

FIG. 4 schematically represents the combined process of one-stage solvent deasphalting and delayed coking for producing the needle coke. The process is as follows:

The stock enters into extractor 5 sequentially via line 1, pump 2, and line 3 after mixing in static mixer 4 with the fresh solvent and recycle solvent respectively from lines 40 and 24. The DAO solution obtained from the top enters into pump 9 via line 6, and enters into critical tower 11 after pressurization. The solvent separated from the top of critical tower 11 returns to extractor 5 sequentially via line 12, line 24, and static mixer 4. The solvent obtained from the bottom of critical tower 11 enters into flash stripper 14 via line 13. The DAO obtained from the bottom of flash stripper 14 partly or entirely enters into the delayed coker via line 16. The solvent obtained from the top of flash stripper 14 returns to extractor 5 sequentially via line 15, pump 23, line 24, and static mixer 4. The asphalt solution obtained from the bottom of extractor 5 enters into flash stripper 20 via line 7. The deoiled asphalt obtained from the bottom of flash stripper 20 leaves the unit via line 22. The solvent obtained from the top of flash stripper 20 returns to extractor 5 sequentially via line 21, pump 23, line 24, and static mixer 4.

A part or all of the DAO from line 16 enters into mild thermal converter furnace 41 via line 26 for heating after mixed with the coker recycle oil from line 25 and enters into buffer tank 43 via line 42. The light components separated from the top of buffer tank 43 enter into coking fractionator 35 via line 44 to separate into gas, gasoline, and diesel, and the separated heavy components serve as the stock for the needle coke. The heavy components separated from buffer tank 43 enter into the convection and radiation sections of coking furnace 27 via line 45 together with another stock for the needle coke from line 46. After being heated, the mixed steam enters into coker drum 32 or 33 sequentially via pump 28, line 29, valve 30, and line 31. The produced needle coke remains in the coker drum, and the coker oil and vapor enter into the fractionator 35 via line 34. The coker oil and vapor, together with the light components from the mild thermal conversion, are fractionated into coker gas, coker gasoline, coke diesel, and coker gas oil, which leave the unit respectively via lines 36, 37, 38, and 39. The coker recycle oil mixes with the DAO and the mixture serves as the feed to mild thermal converter furnace 41.

The heavy asphaltene in residues consists of large molecule aromatics with condensed rings. It comprises a high content of impurities and is prone to coke when heated. The combined process provided by the present invention first removes the heavy asphaltene prone to coking and retains the soft asphalt by the low degree solvent deasphalting, and then uses the low degree deasphalted oil as a feed for delayed coking having small recycle ratios or an once-through scheme. As a result, the yield of the liquid products is raised, the run length of the delayed coker is extended, and the impurity content in the coke product is reduced. The asphaltene in residues is unfavorable to the formation and growth of the mesophase. The combined process provided by the present invention removes the asphaltene by the low degree solvent deasphalting at first to greatly reduce the components unfavorable to the formation of the mesophase, and then carries out the delayed coking according to the operation conditions for producing the needle coke used for high power electrode, thereby produces premium petroleum coke used for high power electrode and enlarges the sources of the coke used for high power electrode.

The following examples will further describe the process provided by the present invention, but not hence restrict the present invention.

EXAMPLE 1

The present example uses vacuum residue A as a deasphalting stock, the properties of which are shown in Table 1. It can be seen from Table 1 that vacuum residue A belongs to a high sulfur residue with a sulfur content up to 4.3 wt % and an asphaltene content up to 5.5 wt %.

The unit for the experiment was a one-stage solvent deasphalting pilot plant and a delayed coking pilot plant. The capacity of the solvent deasphalting pilot plant was 1.1 kg/h and the capacity of the pilot plant delayed coker was 50 kg per coker drum.

n-Butane/n-pentane (volume ratio 65/35) was used as a solvent in the solvent deasphalting pilot plant, the conditions and material balance of which are shown in Table 2. It can be seen from Table 2 that the yield of DAO attained 89.0 wt % after processed by solvent deasphalting, and the balanced was hard asphalt. The properties of DAO and the hard asphalt derived in the solvent deasphalting unit are shown in Table 3. It is seen from Table 3 that the properties of DAO were greatly improved compared with the stock. The content of asphaltene dropped from 5.5 wt % to 0.9 wt %, and that of the carbon residue dropped from 20.5 wt % to 12.4 wt %. The softening point of the hard asphalt was up to 155° C., and the carbon residue was up to 53.9 wt %, which can be used as a fuel.

The delayed coking experiment was carried out in the delayed coking pilot plant with DAO as a stock. The conditions and material balance are shown in Table 4, and the properties of the products are shown in Table 5. It can be seen from Table 4 that the yield of the coker liquid products (i.e. coker gasoline, coker diesel, and coker gas oil, the same hereinafter) was 74.65 wt %. It can be seen from Table 5 that the ash content in coke was 0.11 wt %, and the sulfur content was 3.9 wt %.

COMPARATIVE EXAMPLE 1

Compared with Example 1, vacuum residue A was directly coked as a coking stock without deasphalting. See Table 4 for the conditions and material balance and Table 5 for the properties of the products. It can be seen from Table 4 that the yield of the liquid products was 62.51 wt % after vacuum residue A was treated by delayed coking, which was markedly lower than the yield of the liquid products in coking of DAO in Example 1. It can be seen from Table 5 that the ash content in coke was 0.36 wt %, and the sulfur content is 6.1 wt %, respectively being 3.27 and 1.56 times of Example 1. It is known that, the quality of the coke product is improved by using low degree solvent deasphalting.

EXAMPLE 2

The present example used vacuum residue B as a stock, the properties of which are shown in Table 1. It can be seen from Table 1 that vacuum residue B belongs to a high sulfur residue with a sulfur content up to 3.2 wt % and an asphaltene content up to 6.7 wt %. The unit was the same as that in Example 1.

n-Pentane ($C_5$) was used as a solvent in the solvent deasphalting pilot plant, the conditions and material balance of which are shown in Table 2. It can be seen from Table 2 that the yield of DAO attained 85.2 wt % after processing by solvent deasphalting, and the balanced was hard asphalt.

The properties of DAO and the deoiled asphalt are shown in Table 3. It is seen from Table 3 that the properties of DAO were greatly improved compared with the stock. The content of asphaltene dropped from 6.7 wt % to 1.1 wt %, and that of carbon residue dropped from 20.0 wt % to 13.2 wt %.

The delayed coking experiment was carried out in the delayed coking pilot plant with DAO as a stock. The conditions and material balance are shown in Table 4, and the properties of the products are shown in Table 5. It can be seen from Table 4 that the yield of the coker liquid products was 72.86 wt %. It can be seen from Table 5 that the ash content in coke was 0.20 wt %, and the sulfur content was 3.0 wt %.

COMPARATIVE EXAMPLE 2

Compared with Example 2, vacuum residue B was directly coked as a coking stock without deasphalting. See Table 4 for the conditions and material balance and Table 5 for the properties of the products. It can be seen from Table 4 that the yield of the liquid products was 61.63 wt % after vacuum residue B was treated by delayed coking, which was markedly lower than the yield of the liquid products in coking of DAO in Example 2. It can be seen from Table 5 that the ash content in coke was 0.41 wt %, and the sulfur content was 4.1%, respectively being 2.05 and 1.36 times of Example 1. It is known that the quality of the coke product is improved by using low degree solvent deasphalting.

EXAMPLE 3

The present example uses vacuum residue C as a deasphalting stock. It can be seen from Table 6 that the sulfur content in vacuum residue D was 0.42 wt %.

The unit for the experiment was a one-stage solvent deasphalting pilot plant, the capacity of which was 3.0 kg/h. n-Butane/n-pentane (volume ratio 65/35) was used as a solvent, the conditions and material balance of which are shown in Table 7. It can be seen from Table 7 that the yield of the DAO attained 80.0 wt % after processing by solvent deasphalting, and the balanced was hard asphalt. The properties of DAO and the hard asphalt derived in the solvent deasphalting unit are shown in Table 8. It can be seen from Table 8 that the properties of the DAO were greatly improved compared with the stock. The content of aromatics plus resins was higher than 75.5 wt % and there was no asphaltene. The softening point of the hard asphalt was up to 145° C., and the carbon residue was up to 55.75%, which can be used as a fuel.

The mild thermal conversion and delayed coking experiments were carried out in a delayed coking pilot plant with DAO as a stock. The experiment unit comprises a RIPP pilot plant of mild thermal converter and a RIPP pilot plant of delayed coking. The RIPP pilot plant of mild thermal converter comprised a furnace, a buffer tank and corresponding recovery equipment, the capacity was 10 kg/h. The capacity of the pilot plant delayed coker of RIPP was 50 kg. The major equipment includes the furnace, coker, and fractionator. The conditions and material balance are shown in Table 9, and the properties of the products are shown in Table 10.

It can be seen from Table 10 that the CTE of the needle coke produced from vacuum residue C by the mild thermal conversion was less than $2.6\times10^{-6}$/° C., which attained the quality requirement for the petroleum coke used for high power electrode.

The CTE in Examples 3 and 4 was measured using RIPP method. The needle petroleum coke sample was fabricated into a carbon rode and calcined at 1000° C. The CTE was measured on a quartz differential dilatometer in a temperature range of room temperature to 600° C.

EXAMPLE 4

The present example uses vacuum residue D as a deasphalting stock. It can be seen from Table 6 that the sulfur content in vacuum residue D was 0.31 wt %.

The unit for the experiment was a pilot plant of one-stage solvent deasphalting, the capacity of which was 3.0 kg/h. n-Pentane was used as a solvent, the conditions and material balance of which are shown in Table 7. It can be seen from Table 7 that the yield of DAO attained 85.2 wt % after processing by the solvent deasphalting, and the balanced was hard asphalt. The properties of the DAO and the hard asphalt derived in the solvent deasphalting unit are shown in Table 8. It can be seen from Table 8 that the properties of the DAO were greatly improved compared with the stock. The content of aromatics plus resin was higher than 67.1 wt % and there was no asphaltene. The softening point of the hard asphalt was up to 161° C., and the content of carbon residue was up to 54.8 wt %, which can be used as a fuel.

The mild thermal conversion and delayed coking experiments were carried out in a delayed coking pilot plant with the DAO as a stock. The experiment unit comprises a RIPP pilot plant of mild thermal converter and a RIPP pilot plant of delayed coking. The RIPP pilot plant of mild thermal converter comprised a furnace, a buffer tank and corresponding recovery equipment, and its capacity was 10 kg/h. The capacity of the RIPP pilot plant of delayed coking was 50 kg per coker drum. The major equipment includes a furnace, a coker drum, and a fractionator. The conditions and material balance are shown in Table 9, and the properties of the products are shown in Table 10.

It can be seen from Table 10 that the CTE of the petroleum coke produced from vacuum residue D by the mild thermal conversion was less than $2.6\times10^{-6}$/° C., which attained the quality requirement for the petroleum coke used for high power electrode.

TABLE 1

| No. | Example 1 | Example 2 |
|---|---|---|
| Deasphalting stock | Vacuum residue A | Vacuum residue B |
| Density (20° C.), g/cm$^3$ | 0.9997 | 1.0082 |
| Kinematic viscosity (100° C.), mm$^2$/s | 548.0 | 1678.2 |
| Carbon residue, wt % | 20.5 | 20.0 |
| C, wt % | 84.41 | 85.00 |
| H, wt % | 10.44 | 10.29 |
| S, wt % | 4.3 | 3.2 |
| Saturates, wt % | 15.1 | 16.4 |
| Aromatics, wt % | 54.7 | 45.0 |
| Resins, wt % | 24.7 | 31.9 |
| Asphaltenes, wt % | 5.5 | 6.7 |

TABLE 2

| No. | Example 1 | Example 2 |
|---|---|---|
| Conditions | | |
| Deasphalting stock | Vacuum residue A | Vacuum residue B |
| Solvent | n-butane/n-pentane (65/35, v/v) | n-pentane |
| Temperature of extractor, ° C. | | |
| Top | 129 | 150 |
| Bottom | 114 | 135 |
| Pressure of extractor, MPa | 4.0 | 4.0 |
| Solvent/oil ratio, v/v | 6.0 | 4.0 |
| Material balance, wt % | | |
| DAO | 89.0 | 85.2 |
| Deoiled asphalt | 11.0 | 14.8 |

TABLE 3

| No. | Example 1 | Example 2 |
|---|---|---|
| Deasphalting stock | Vacuum residue A | Vacuum residue B |
| Properties of DAO | | |
| Density (20° C.), g/cm$^3$ | 0.9869 | 0.9903 |
| Kinematic viscosity (100° C.), mm$^2$/s | 117.2 | 253.9 |
| Carbon residue, wt % | 12.4 | 13.2 |
| C, wt % | 85.53 | 85.31 |
| H, wt % | 10.33 | 11.13 |
| S, wt % | 3.36 | 2.85 |
| Saturates, wt % | 21.0 | 22.1 |
| Aromatics, wt % | 60.8 | 53.9 |
| Resins, wt % | 17.3 | 22.9 |
| Asphaltenes, wt % | 0.9 | 1.1 |
| Properties of deoiled asphalt | | |
| Softening point (R & B), ° C. | 155 | 161 |
| Carbon residue, wt % | 53.9 | 62.8 |
| S, wt % | 5.2 | 4.3 |

TABLE 4

| No. | Example 1 | Comparative Example 1 | Example 2 | Comparative Example 2 |
|---|---|---|---|---|
| Coking stock | DAO | Vacuum residue | DAO | Vacuum residue |
| Conditions | | | | |
| Furnace outlet temperature, ° C. | 500 | 500 | 500 | 500 |
| Coker drum top | 0.17 | 0.17 | 0.17 | 0.17 |

TABLE 4-continued

| No. | Example 1 | Comparative Example 1 | Example 2 | Comparative Example 2 |
|---|---|---|---|---|
| pressure, MPa | | | | |
| Recycle ratio (wt) | 0.10 | 0.10 | 0.10 | 0.10 |
| Amount of injected water, wt % | 1.5 | 1.5 | 1.5 | 1.5 |
| Material balance, wt % | | | | |
| Coker gas | 6.31 | 8.53 | 7.01 | 9.18 |
| Coker gasoline | 15.12 | 14.31 | 12.30 | 13.01 |
| Coker diesel | 28.90 | 25.67 | 23.88 | 24.17 |
| Coker gas oil | 30.63 | 22.53 | 36.68 | 24.45 |
| Coke | 19.04 | 28.96 | 20.13 | 29.19 |
| Yield of liquid products | 74.65 | 62.51 | 72.86 | 61.63 |

TABLE 5

| No. | Example 1 | Comparative Example 1 | Example 2 | Comparative Example 2 |
|---|---|---|---|---|
| Coking stock | DAO | Vacuum residue | DAO | Vacuum residue |
| Coker gasoline | | | | |
| Density (20° C.), g/cm$^3$ | 0.7384 | 0.7396 | 0.7374 | 0.7376 |
| Bromine number, gBr/100 g | 52.4 | 63.9 | 51.2 | 48.7 |
| Sulfur, wt % | 0.21 | 0.28 | 0.13 | 0.33 |
| Coker diesel | | | | |
| Density (20° C.), g/cm$^3$ | 0.8512 | 0.8542 | 0.8592 | 0.8663 |
| Bromine number, gBr/100 g | 15.3 | 21.5 | 17.8 | 20.9 |
| Freezing point, ° C. | −5 | −3 | −10 | −8 |
| 10% carbon residue, wt % | 0.14 | 0.18 | 0.13 | 0.38 |
| Sulfur, wt % | 1.5 | 2.0 | 0.91 | 1.52 |
| Coker gas oil | | | | |
| Density (20° C.), g/cm$^3$ | 0.9559 | 0.9693 | 0.9514 | 0.9712 |
| Kinematic viscosity (100° C.), mm$^2$/s | 3.358 | 4.720 | 4.206 | 7.192 |
| Carbon residue, wt % | 0.78 | 1.37 | 0.85 | 1.90 |
| S, wt % | 2.9 | 3.71 | 1.80 | 2.60 |
| Coke | | | | |
| Volatile content, wt % | 7.8 | 8.1 | 9.1 | 9.9 |
| Ash, wt % | 0.11 | 0.36 | 0.20 | 0.41 |
| S, wt % | 3.9 | 61 | 3.0 | 4.1 |

TABLE 6

| No. | Example 3 | Example 4 |
|---|---|---|
| Deasphalting stock | Vacuum residue C | Vacuum residue D |
| Density (20° C.), g/cm$^3$ | 0.9984 | 0.9992 |
| Kinematic viscosity (100° C.), mm$^2$/s | 863 | 1088.2 |
| Carbon residue, wt % | 18.8 | 20.0 |
| C, wt % | 87.11 | 87.00 |
| H, wt % | 10.83 | 10.21 |
| S, wt % | 0.42 | 0.31 |
| Saturates, wt % | 18.1 | 19.3 |
| Aromatics, wt % | 31.7 | 34.8 |

TABLE 6-continued

| No. | Example 3 | Example 4 |
|---|---|---|
| Resins, wt % | 44.8 | 42.1 |
| Asphaltenes, wt % | 5.4 | 3.8 |

TABLE 7

| No. | Example 3 | Example 4 |
|---|---|---|
| Conditions | | |
| Deasphalting stock | Vacuum residue C | Vacuum residue D |
| Solvent | n-butane/n-pentane (65/35, v/v) | n-pentane |
| Temp. of extractor, ° C. | | |
| Top | 150 | 175 |
| Bottom | 135 | 155 |
| Pressure of extractor, MPa | 3.8 | 4.0 |
| Solvent/oil ratio, v/v | 8.0 | 4.0 |
| Material balance, wt % | | |
| DAO | 80.3 | 85.2 |
| Deoiled asphalt | 19.7 | 14.8 |

TABLE 8

| No. | Example 3 | Example 4 |
|---|---|---|
| Deasphalting stock | Vacuum residue C | Vacuum residue D |
| Properties of DAO | | |
| Density (20° C.), g/cm$^3$ | 0.9650 | 0.9687 |
| Kinematic viscosity (100° C.), mm$^2$/s | 120 | 274.8 |
| Carbon residue, wt % | 9.8 | 11.81 |
| C, wt % | 87.40 | 86.41 |
| H, wt % | 11.45 | 11.72 |
| S, wt % | 0.35 | 0.24 |
| Saturates, wt % | 24.5 | 32.91 |
| Aromatics, wt % | 37.1 | 35.44 |
| Resins, wt % 38.4 | 31.65 | |
| Asphaltenes, wt % | 0.0 | 0.0 |
| Properties of deoiled asphalt | | |
| Softening point (R & B), ° C. | 145 | 161 |
| Carbon residue, wt % | 55.7 | 54.8 |

TABLE 9

| | Example 3 | Example 4 |
|---|---|---|
| Mild thermal conversion | | |
| Temperature at the outlet of the converter, ° C. | 435 | 431 |
| Pressure, MPa | 0.70 | 0.70 |
| Amount of injected water, wt % | 2.0 | 2.2 |
| Residence time, s | 75 | 83 |
| Delayed coking | | |
| Recycle ratio (coker recycle oil) | 0.20 | 0.41 |
| Temperature at the outlet of the furnace, ° C. | 400–450 | 400–450 |
| Pressure at the top of the coker drum, MPa | 0.30 | 0.30 |
| Material balance, wt % | | |
| Gas | 13.6 | 14.8 |
| Gasoline | 17.8 | 12.9 |
| Diesel | 24.6 | 22.6 |

TABLE 9-continued

| | Example 3 | Example 4 |
|---|---|---|
| Gas oil | 11.5 | 13.4 |
| Coke | 32.5 | 36.3 |

TABLE 10

| No. | Example 3 | Example 4 |
|---|---|---|
| Coker gasoline: | | |
| Density (20° C.), g/cm$^3$ | 0.7589 | 0.7558 |
| Bromine number, gBr/100 g | 26.4 | 27.3 |
| Sulfur, ppm | 606 | 584 |
| Coker diesel: | | |
| Density (20° C.), g/cm$^3$ | 0.8982 | 0.8932 |
| Bromine number, gBr,100 g | 18.4 | 17.9 |
| Freezing point, ° C. | −26 | −18 |
| Aniline point, ° C. | 35.8 | 41.3 |
| 10% carbon residue, wt % | 0.16 | 0.04 |
| Sulfer, ppm | 842 | 819 |
| Coker gas oil: | | |
| Density (20° C.), g/cm$^3$ | 1.063 | 1.135 |
| Carbon residue, wt % | 0.19 | 0.90 |
| Sulfur, wt % | 0.56 | 0.38 |
| Needle coke: | | |
| Ash, wt % | 0.06 | 0.05 |
| Volatile content, wt % | 9.6 | 9.2 |
| Sulfur, wt % | 0.39 | 0.33 |
| Real density, g/cm$^3$ | 2.184 | 2.140 |
| CTE, x10-6/° C. (RIPP method) | 2.57 | 2.49 |

What is claimed is:

1. A multi-step process for treating hydrocarbon oil by a combined process of low degree solvent deasphalting and delayed coking, which comprises the following steps:

(1) A preheated deasphalting stock and a solvent enter into an extractor, and a solvent-containing deoiled asphalt solution is withdrawn from the bottom of the extractor; the deasphalted oil solution from the top of the extractor yields the deasphalted oil after recovering the solvent; the yield of the deasphalted oil is 70 wt %–95 wt % relative to the deasphalting stock; and (2) A part or all of the deasphalted oil and a coker recycle oil from a fractionator, and optionally another conventional coking stock enter into the convection section of the furnace of the delayed coker for heating, then enter into the radiant section of the furnace for heating, and finally enter into a coker drum to conduct the coking reaction; coke remains in the coker drum, and coker oil and vapor escape from the top of the coker drum and enter into the fractionator, wherein they are separated into gas, gasoline, diesel, and gas oil; the coker recycle oil is mixed with the deasphalted oil and the mixture enters into the convection section of the furnace of the delayed coker.

2. The process of claim 1, wherein said conventional coking stock is one selected from the group consisting of vacuum residue, atmospheric residue, visbreaking cracked residue, catalytically cracking decanted oil, thermal cracking residue, heavy oil hydrogenated tail oil, extract from lube solvent refining or ethylene tar, or a mixture thereof.

3. The process of claim 1, wherein the temperature at the outlet of said delayed coking furnace is 480° C.–510° C., the recycle ratio is 0–0.25, and the pressure is 0.1 MPa–1.0 MPa.

4. A multi-step process for treating hydrocarbon oil by a combined process of low degree solvent deasphalting and delayed coking, which comprises the following steps:

(1) A preheated deasphalting stock and a solvent enter into an extractor, and a solvent-containing deoiled asphalt solution is withdrawn from the bottom of the extractor; the deasphalted oil solution from the top of the extractor yields the deasphalted oil after recovering the solvent; the yield of the deasphalted oil is 70 wt %–95 wt % relative to the deasphalting stock;

(2) A part or all of the deasphalted oil and coker recycle oil enter into the furnace of a mild thermal converter, and the light components obtained by separation of the heated stream enter into the fractionator of the delayed coker while the heavy components enter into the furnace of the delayed coker; and (3) The heavy components subjected to the mild thermal reaction and optionally another stock for the needle coke enter into the furnace of the delayed coker for heating and then enter into the coker drum for coking reaction; coker oil and vapor escape from the top of the coker drum and enter into the fractionator, wherein they are separated into gas, gasoline, diesel, and gas oil; the coker recycle oil is mixed with the deasphalted oil and the mixture enters into the furnace of the mild thermal converter, and the needle coke remains in the coker drum.

5. The process of claim 4, wherein the temperature at the outlet of the furnace of said mild thermal converter is 370° C.–510° C., the amount of the injected water accounts for 0–20 wt % of the feed, the pressure is 0 MPa–1.0 MPa, and the residence time is 2 s–180 s.

6. The process of claim 4, wherein said another stock for the needle coke is one selected from the group consisting of catalytically cracking decanted oil, thermal cracking residue, heavy oil hydrogenated tail oil, extract from lube solvent refining or ethylene tar, or a mixture thereof.

7. The process of claim 4, wherein said temperature at the outlet of the furnace of the delayed coking is 430° C.–520° C., the recycle ratio is 0–0.25, the pressure is 0MPa–1.0 MPa, the amount of the injected water accounts for 0 wt %–20 wt % of the feed, and the residence time is 2 s–180 s.

8. The process of claim 1 or 4, wherein said deasphalting stock is one selected from the group consisting of vacuum residue, atmospheric residue, visbreaking cracked residue, catalytically cracking decanted oil, thermal cracking residue, heavy oil hydrogenated tail oil, extract from lube solvent refining or ethylene tar, or a mixture thereof.

9. The process of claim 1 or 4, wherein said solvent is one selected from the group consisting of $C_3$–$C_7$ alkanes or olefins, condensed oil, light naphtha, and light gasoline, or a mixture thereof.

10. The process of claim 9, wherein said solvent is one selected from the group consisting of $C_4$–$C_6$ alkanes or olefins, or a mixture thereof.

11. The process of claim 1 or 4, wherein said deasphalting stock and solvent enter into the extractor from the upper part and the lower part respectively and come into countercurrent contact, or are pre-mixed before entering into the extractor for separation.

12. The process of claim 1 or 4, wherein the solvent deasphalting process may be an one-stage scheme, the liquid stream from the top of the extractor yields deasphalted oil after solvent recovery, and the liquid stream from the bottom of the extractor yields deoiled asphalt after solvent recovery; or a two-stage scheme, wherein the liquid stream from the bottom of the extractor yields deoiled asphalt after solvent recovery, while the liquid stream from the top of the extractor enters into a settler for settling; the liquid stream from the top of the settler yields deasphalted oil after solvent recovery, and the liquid stream from the bottom of the settler yields resins after solvent recovery.

13. The process of claim 1 or 4, wherein the operation conditions in solvent deasphalting are as follows: the temperature is 60° C.–280° C., the pressure is 1.0 MPa–6.0 MPa, and the solvent/oil ratio is 1.0 v/v–15.0 v/v.

14. The process of claim 1 or 4, wherein the solvent deasphalting is conducted under either the subcritical or supercritical conditions of the solvent.

15. The process of claim 1 or 4, wherein the solvent in the deasphalted oil solution is recovered under either the critical or supercritical conditions of the solvent.

16. The process of claim 1 or 4, wherein the yield of said deasphalted oil is 80 wt %–90 wt % relative to the deasphalting stock.

* * * * *